US007703714B2

(12) United States Patent
Becker et al.

(10) Patent No.: US 7,703,714 B2
(45) Date of Patent: Apr. 27, 2010

(54) COMMINUTION MACHINE

(75) Inventors: Udo Becker, Menden (DE); Michael Böhlefeld, Balve (DE)

(73) Assignee: AMNI Maschinenbau GmbH (DE)

( * ) Notice: Subject to any disclaimer, the term of this patent is extended or adjusted under 35 U.S.C. 154(b) by 0 days.

(21) Appl. No.: 12/193,572

(22) Filed: Aug. 18, 2008

(65) Prior Publication Data

US 2009/0045276 A1 Feb. 19, 2009

(30) Foreign Application Priority Data

Aug. 17, 2007 (DE) ..... 20 2007 011 572 U

(51) Int. Cl.
*B02C 18/18* (2006.01)

(52) U.S. Cl. ..... 241/242; 241/286

(58) Field of Classification Search ..... 241/242, 241/243, 286

See application file for complete search history.

(56) References Cited

U.S. PATENT DOCUMENTS 5,060,875 A * 10/1991 McBride ..... 241/242
5,452,860 A * 9/1995 Williams ..... 241/78
6,565,026 B1 * 5/2003 Hall ..... 241/225

FOREIGN PATENT DOCUMENTS

DE 202005013719 U1 3/2006

* cited by examiner

*Primary Examiner*—Mark Rosenbaum
(74) *Attorney, Agent, or Firm*—Margaret Polson; Oppedahl Patent Law Firm LLC

(57) ABSTRACT

A coarse material comminution machine 1 comprises a rotor 2 fitted with blades 4 and a stator body 3 located on the stator side with at least one blade 5 adjustable by means of a control device 11 in the direction towards the rotor 2 and in the direction away from the rotor 2. The control device has an adjusting slide 12 that is movable relative to the rotor 2 as well as an activating device 13 for the movement of the adjusting slide 12 in the direction towards the rotor 2 and in the direction away from the rotor 2. The blade 5 is kinetically coupled to a movement of the adjusting slide 12. The blade 5 is connected to the adjusting slide 12 by one or several coupling members 14 connectible to the adjusting slide 11 and the blade 5 in form-fitting and detachable fashion.

8 Claims, 4 Drawing Sheets

COMMINUTION MACHINE

CROSS REFERENCE APPLICATIONS

This application claims priority from German application no. 20 2007 011 572.5 filed Aug. 17, 2007.

BACKGROUND

Comminution machines are used to reduce the particle size of hard material in industrial processes. Comminution machines that are granulators are equipped with a rotor fitted with blades. The blades can be chipper knives, with several chipper knives typically being arranged lying one behind the other in the rotational direction of the rotor. The arrangement of blades of the rotor essentially extends across its entire longitudinal extension.

The rotor blades work together with the blades of a stator body during maceration operations. The stator is kept fixed in place in relation to the rotational movements of the rotor. The stator body bears one or more blades arranged in a row parallel to the shell of the rotor. The blades of the stator are typically designed as cutter bars. The edge of the blade pointing against the rotational direction of the rotor functions as cutting edge and acts with the rotor blades to macerate the feed material.

During operation of such a comminution machine, the blades and particularly the stator blade or blades, become worn, resulting in an increases of the cutting gap between the rotor blades and the stator blade. The stator blade(s) are worn faster because several rotor blades are generally arranged one behind the other in the rotational direction of the rotor, so a single stator blade represents the stator blade for several rotor blades. Therefore, comminution machines have been developed that have a stator body whose blades can be moved in the direction towards the rotor using an adjustment mechanism to compensate for the enlargement of the cutting gap occurring during operation.

In previously known stator bodies with adjustable blades the adjustment mechanism acts directly on the blades. The blade or blades can be moved towards the rotor using adjustment device, for example an adjustment spindle, to compensate for the increasing cutting gap caused by wear. These blade readjustments are typically done manually. During the readjustment of the stator blade(s), care must be taken to ensure that the stator blade(s) are not moved too far towards the rotor to prevent blocking the rotation of the rotor. If a blade has been moved too far towards the shell of the rotor, a user has to open the entire blade mounting and move the adjusting mechanism back before a new blade adjustment can be done. This is time-consuming.

In DE 20 2005 013 719 1, a stator adjustment mechanism for a comminution machine is described with an adjustable stator blade that can be moved either towards the rotor or away from it. The stator adjustment mechanism has a push-pull screw, a lever and an adjustment screw. The push-pull screw is attached to a connecting element which in turn provides the form-fitting connection with the stator blade. The adjustment screw acts on the push-pull screw via a lever integrated into a housing. This allows adjustment of the stator blade without releasing the pre-stress on the blade. This prior art comminution machine has a stator adjustment mechanism which moves the stator blade towards and away from the rotor with relative ease. However, the exchange of a worn-out blade in the prior art machine is laborious and time-consuming. In addition, the blades need to be equipped with long mounting holes for the mounting screws to engage.

The foregoing example of the related art and limitations related therewith are intended to be illustrative and not exclusive. Other limitations of the related art will become apparent to those of skill in the art upon a reading of the specification and a study of the drawings.

SUMMARY

The invention relates to a coarse material comminution machine comprising a rotor fitted with blades and a stator body located on the stator side with at least one blade adjustable by means of a control device both towards away from the rotor.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

A generic coarse material comminution machine has an adjustment mechanism with an adjusting slide movable relative to the rotor as well as an activating mechanism to move the adjusting slide both towards the rotor and away from the rotor. The blade is kinetically coupled to any movement of the adjusting slide by means of at least one coupling member attachable to the adjusting slide. Finally, the blade is detachable and form-fitting.

The coarse material comminution machine has an adjustment mechanism that comprises an adjusting slide and an activating mechanism to move the adjusting slide.

The adjusting slide is moved by the activating mechanism translating movement both towards and away from the rotor. The blade in turn is coupled kinetically to a movement of the adjusting slide. In this configuration, the motion conversion of a typically rotationally driven activating mechanism to the translation motion for a readjustment of the blade occurs via the adjusting slide. A blade adjusted by this type of an adjustment mechanism can have a very simple geometry, allowing for easy replacement and economical manufacturing. Although, the blade wears in use and needs to be replaced, the adjusting slide does not need to be replaced as part of a blade replacement.

In accordance with a disclosed embodiment, the blade is coupled to the adjusting slide by two motion-transferring mechanisms. For movement of the blade towards the rotor, a transfer of a thrust motion of the adjusting slide occurs onto the blade by the abutment of two facing surfaces, one each the slide and the blade. Thus, the motion transfer occurs by a direct thrust force.

The blade is coupled to the adjusting slide by at least one coupling member to enable the blade to be moved away from the rotor. The coupling members are removably attached to the adjusting slide and the blade. In principle, the forward thrust motion can be transferred from the adjusting slide to the blade by the coupling members. However, in such an embodiment, the coupling members would also have to absorb the knocks transmitted from the blade in the direction away from the rotor during operation of the machine. When the rear side blade abuts the facing surface of the adjusting slide directly with these knocks are better absorbed. Therefore, the coupling members only need to be stable enough to retract the blade in such an embodiment. The coupling members can have some play in the coupling when the facing surface of the adjusting slide abuts the facing surface of the blade. This provides some protection for the coupling members from damage. However, this is irrelevant for the adjustment of the blade.

The coupling member may be formed by two coupling projections located at a distance from each other and connected by a bar. In the case of such a design, the adjusting slide and the blade each have a recess for the attachment of a coupling member.

Such a coupling member can be installed and removed again with great ease. This reduces the effort required during a blade exchange or rotation to a minimum.

In order to be able to use both edges of blade towards the rotor, one embodiment provides that the recesses of the blade to be designed as end-to-end drill holes. There are simple in their manufacture and allow reversing of the blade with great ease.

Typically, a stator body has several of such blades and a corresponding number of adjustment mechanisms, with one adjustment mechanism allocated to each blade. It is of course also possible to provide an adjustment mechanism that allows several blades to be adjusted.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
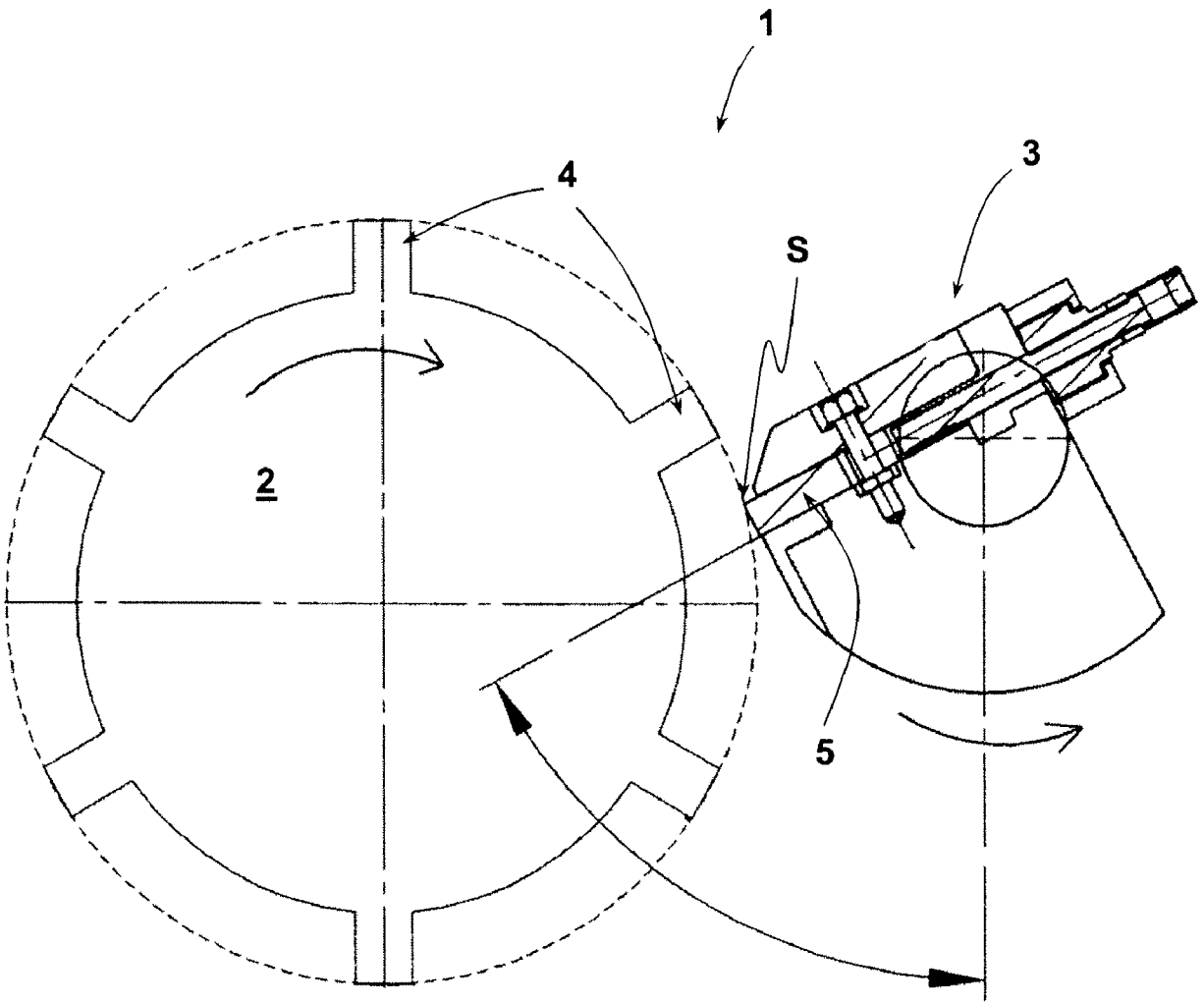
FIG. 1 is a largely schematic lateral view of a coarse material comminution machine.

A coarse material comminution machine 1 is represented schematically in FIG. 1 in the circumference of its rotor 2 and its stator body 3. Not shown are all other elements, for example the frame the rotor 2 is mounted in and which holds the stator body 3. The rotor 2 has a multitude of blades 4. The depicted embodiment has six blades 4 arranged behind each other in circumferential direction and at the same angular distance to each other. The stator body 3 is described in detail with regard to FIGS. 2 through 5.

The stator body 3 is arranged in rotatable fashion in a way not depicted in detail. FIG. 1 shows the stator body 3 in its position during macerating operation. The stator body 3 rotates in the direction of the arrow in FIG. 1 when a non-grindable fragment is pulled into the cutting gap S. The stator body 3 with its stator blade will rotate counterclockwise enlarging the cutting gap S. This helps to prevent damage to the blade 5 in the event of an obstacle being sucked in. When the stator body 3 rotates depends on the torque. The stator body 3 rotates away when the torque acting on the blade 5 is exceeds a preset limit.

Figure 2:
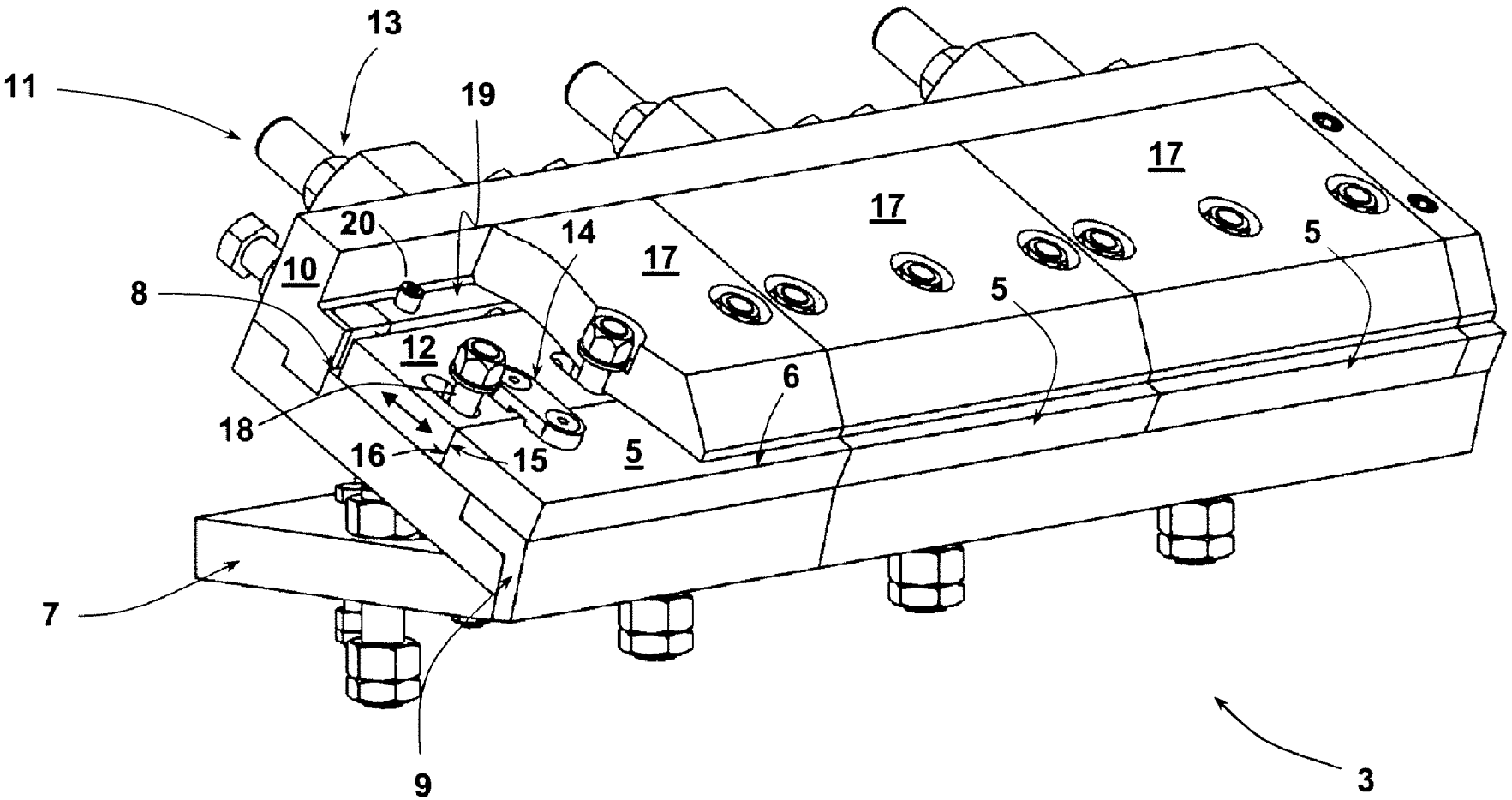
FIG. 2 is a perspective and partially cut away view of the stator body of the coarse material comminution machine of FIG. 1.
Figure 4:
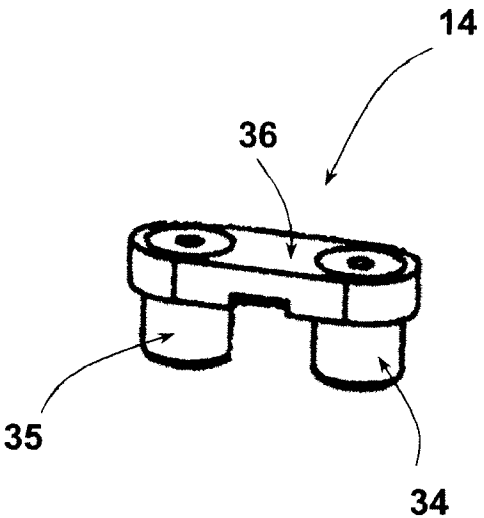
FIG. 4 is perspective view a coupling member of FIG. 3.

As can be seen in FIG. 2, the stator body 3 bears a multitude of blades 5 arranged parallel to the shell of the rotor 2. These blades 5 are cutter bars. The upwardly turned edge 6 of a stator blade 5 interacts with the blades 4 of the rotor 2.

In the depicted embodiment, the stator body 3 comprises an angularly designed base body 7 whose upper surface 8 is the support surface for the blades 5. The front side of the base body 7 facing the rotor 2 is protected by a wear protection piece 9. The wear protection piece is made of a particularly robust material. The base body 7 has a retaining bar 10 on the side opposite the blade 5.

An adjustment mechanism comprised of an adjusting slide 12 and an activating mechanism 13 adjusts the rotor blade 5 in relation to the cutting gap S. The adjusting slide 12 moves in the directions indicated by the double arrow in FIG. 2 on the upper side 8 of the base body 7. The movement is either towards or away from the rotor 2. The activating mechanism 13 moves the adjusting slide 12 in those directions. In the depicted embodiment, the activating mechanism 13 is a spindle operation as described below with regard to FIGS. 3 and 5. Each stator blade 5 has an adjustment mechanism 11 with an adjusting slide 12. The stator blade 5 is connected to the adjusting slide 12 by two coupling members 14, one of which can be seen in FIG. 2. As shown in FIG. 2, when the stator body is in use the side 15 of the adjusting slide abuts the rear side 16 of the blade 5. In this way, any motion of the adjusting slide 12 towards the rotor 2 is transmitted onto the blade 5 as a thrust motion. Consequently, during such an adjustment the blade 5 is displaced towards the rotor 2 or, respectively, its blades 4.

The blade 5 is coupled to the adjusting slide 12 in pull-resistant fashion by the coupling members 14 for movement of the blade 5 in the opposite direction and thus away from the rotor 2. An adjustment of the blade 5 occurs by an activation of the activating mechanism 13 a given direction to adjust the cutting gap S. The blades 5 are held in place by pressure plate 17. In the depicted embodiment the pressure plate 17 acts only on the frontal area of each individual blade 5. Each pressure plate 17 has a recess on its underside for the coupling members 14. The pressure plates 17 are held in place by stay bolts 18. The exertion of pressure on the blades 5 alone is achieved by the pressure plate 17 being supported in the frontal end by the stator blade 5 and in the rear end by a ledge 19 of the retaining rail 10. As can be seen in FIG. 2, the ledge 19 is higher than the adjusting slide 12. Thus the pressure plates 17 are held in place like a two-point mounting and in principle never jam the adjusting slide 12. To assure that the whole pressure plate 17 remains fixed in place against movement of the respective stator blade, dowel pins 20 on ledge 19 of the retaining rail 10 engage with the underside of each pressure plate 17. The pressure plate 17 is supported on the rear side by the retaining rail 10.

Figure 3:
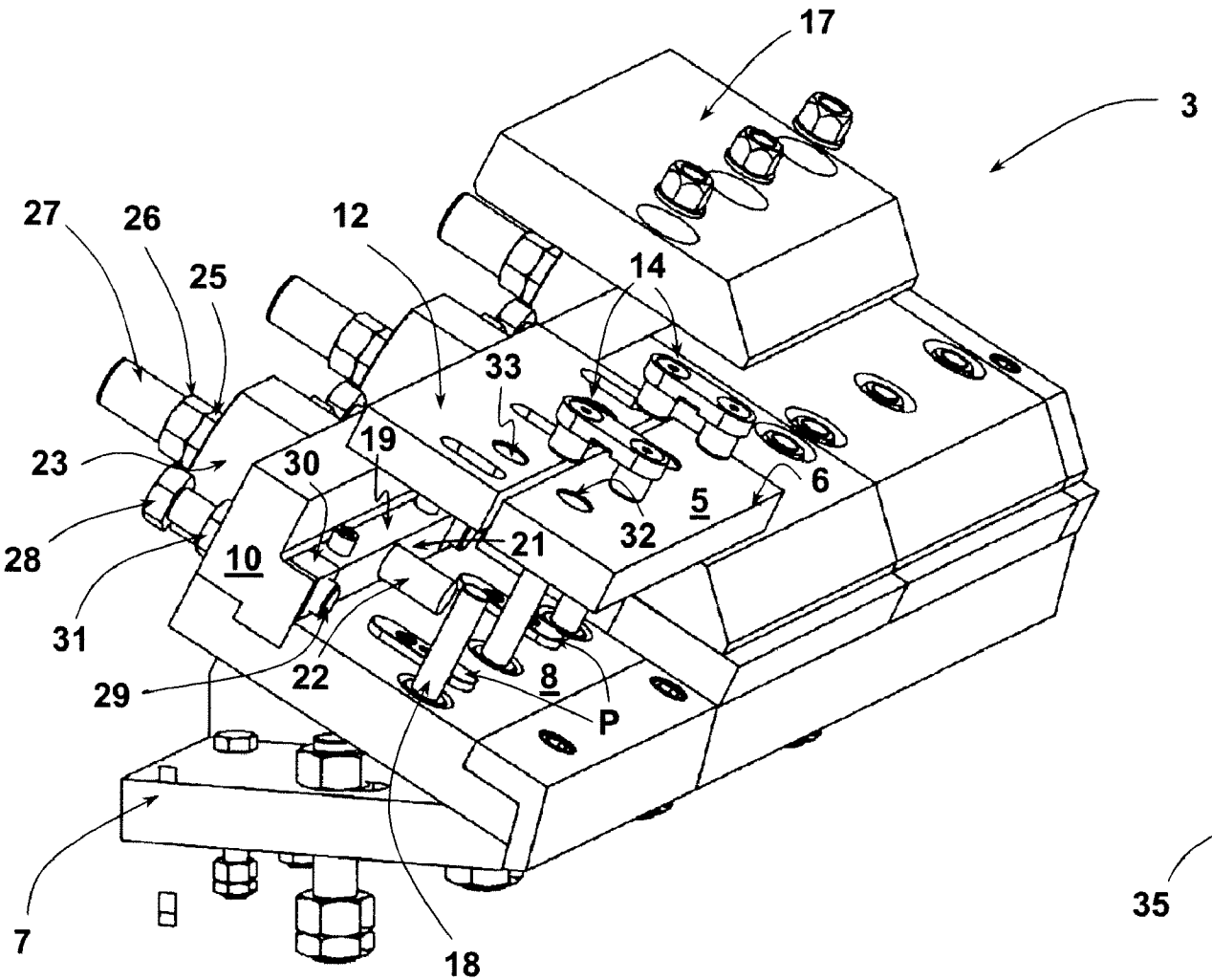
FIG. 3 is a partially exploded perspective view of the stator body of the coarse material comminution machine of FIG. 2.
Figure 5:
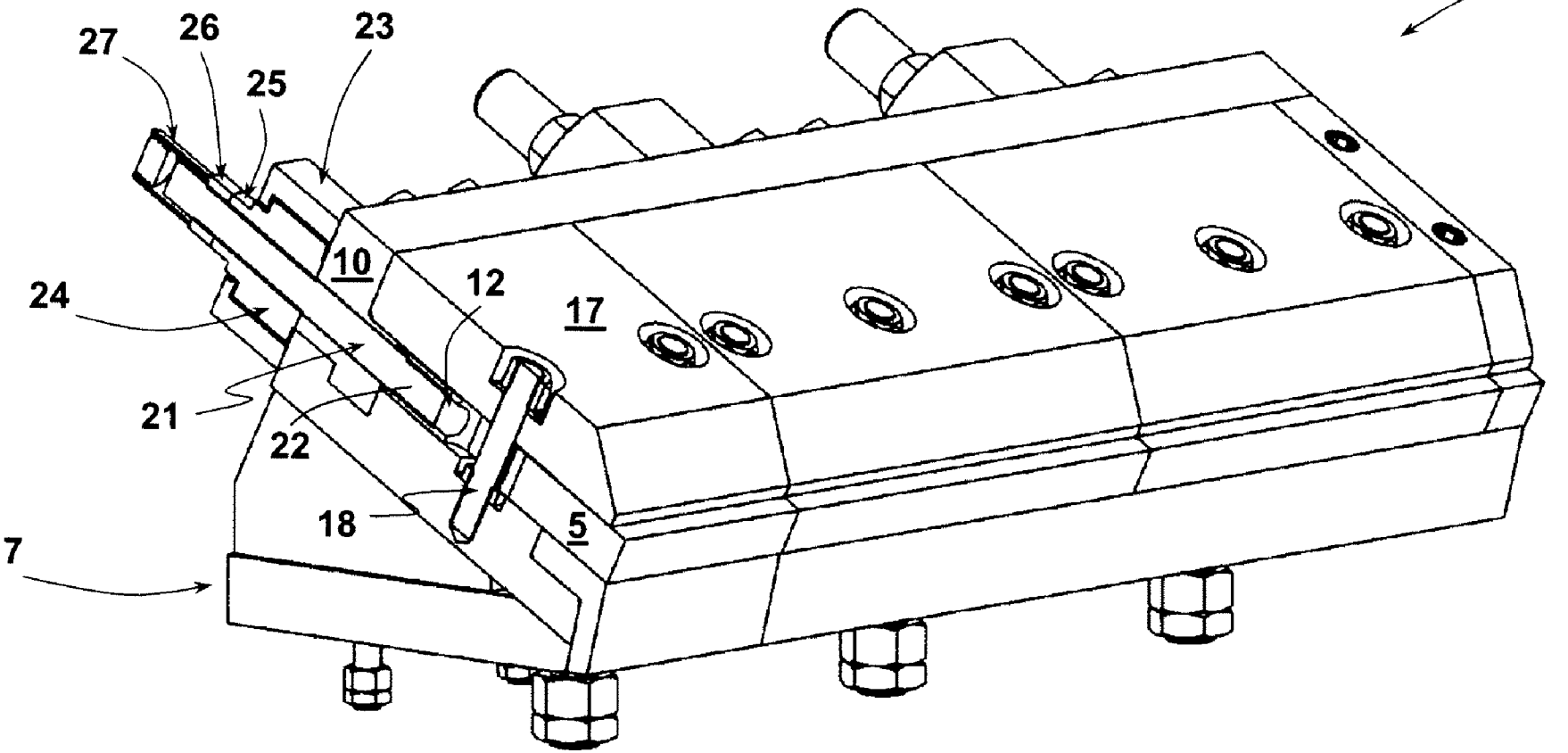
FIG. 5 is a perspective view of the stator body in another cutting plane.

The activation mechanism 13, which designed as a spindle operation, functions to move the adjusting slide 12. The spindle drive 13 has a standing spindle 21 that penetrates the retaining rail 10 and protrudes with a threaded section 22 from the retaining rail in the direction towards the rotor-side end of the base body 7, as seen in FIGS. 3 and 5. The threaded section 22 is screwed into the rear side of the adjusting slide 12. The spindle drive further comprises a spindle nut 24, seen in FIG. 5, arranged in a bearing case 23 that is supported by the rear side of the retaining rail 10 with a thrust and friction bearing. Key surfaces 25 are formed on the spindle nut 24 outside of the bearing case. Thus, the spindle drive 13 can be activated by means of the spindle nut 23.

Turning the spindle nut 23 will cause a translatory movement of the spindle 21. After adjusting the cutting gap S, the spindle nut 24 is fixed with a counter nut 26. A capsule tube 27 is formed on the counter nut which accommodates the section of the spindle 21 that extends beyond the counter nut 26.

Two pressure screws 28 are supported at their foot end 29 by the rear side of the adjusting slide and serve to support the rear of the adjusting slide 12. Each pressure screw 28 reaches through the retaining rail 10 and through a threaded plate 30 that is placed into a recess of the retaining rail 10, as seen in FIG. 3. A counter nut 31 serves to fix each arranged pressure screw 28. After adjusting the cutting gap S by activating the spindle drive 13 to move the adjusting slide 12 away from the retaining rail 10 and towards the rotor 2, the pressure screws 28 are readjusted accordingly in order to achieve the rearward support of the adjusting slide 12.

The blade 5 and the adjusting slide 12 each have recesses 32, 33, that are designed as end-to-end drill holes. The recesses 32, 33 accommodate one coupling projection 34, each of a coupling member 14. A coupling member 14 is shown in an enlarged representation in FIG. 4. The two coupling projections 34, 35 are connected together by a bar 36. The bar 36 is formed so that it can transmit a pulling force from the adjusting slide 12 to the blade 5. The coupling projections 34, 35 have a round cross section in the depicted embodiment and fit with play into the recesses 32, 33. The distance of the recesses 32, 33 and the coupling projections 34, 35 to each other is designed such that during a thrust operation of the spindle drive 13 the adjusting slide 12 abuts the rear side of the blade 5 with facing surface 15 toward the blade 5. This play permits an easy loosening and insertion of the coupling members 14 for a kinetic connection of a blade 5 to a movement of the adjusting slide 12.

When the coupling projections 34, 35 of coupling members 14 are inserted into the recesses 32, 33 the underside bars 36 rest on the upper side of the adjusting slide 12 or, respectively, of the blade 5 as shown in FIG. 2. The pressure plates 17 have a recess at the corresponding location extending in the direction of the movement of the adjusting slide 12 and of the blade 5. The coupling members 14 can be moved in this recess with the movement of the blade 5. The inner width of recess in the underside of the pressure plate 17 is the width of the bars 36 of the coupling members 14 or slightly larger to assure the desired mobility of the coupling members 14 in the recesses. This quite precise engagement of the coupling members 14 in the corresponding guidance parts of the pressure plate 17 serves an additional fixing of the pressure plate in the event of any knocks on the stator blades 5. The adjusting slide 12 has recesses on its underside so that fitted keys P are guided in a like manner to which the coupling members 14 engage in the underside of the pressure plate 17. Through this measure, the pressure plates 17 are supported at their rear end by the retaining rail 10 and are fixed and supported in a transversal direction in form-fitting fashion.

Since the adjusting slide 12 is tightly connected to the spindle drive 13, and due to the afore-described kinematic coupling of the blade 5 with the adjusting slide 12, the blade 5 can be moved by means of the spindle drive 13 in a direction either towards the rotor 2 or away from it. This makes an adjustment of the cutting gap S particularly easy.

Likewise a blade exchange can be carried out with a few hand movements on the afore-described stator body 3. After removing the pressure plate 17, the two coupling members 14 are removed from their position connecting the adjusting slide 12 with the blade 5. Then the blade 5 can be easily removed or turned over. An assembly occurs in the reverse order. A blade replacement requires only that the pressure plate 17 be slightly loosened to undo the jamming effect acting on the blade 5, to with only far enough that the blade 5 can be translatorily moved in one direction or the other by means of the spindle drive 12. After adjusting the cutting gap S, the pressure 17 is fixed in place again.

In an embodiment not shown in the figures, the stator blade is connected directly to a spindle drive as described in FIGS. 2 through 6. In such an embodiment, the latter acts in this manner on the adjusting unit without the intervention of an adjusting slide for the blade. Due to its connection to the spindle drive, this blade, too, can be moved in a translatory direction towards the rotor and away from the rotor.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true sprit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

REFERENCE LIST

1 Comminution machine
2 Rotor
3 Stator Body
4 Blade
5 Stator Blade
6 Edge
7 Base Body
8 Upper Side
9 Wear Protection Pie e
10 Retaining Rail
11 Adjustment Unit
12 Adjusting Slide
13 Activating Device, Spindle Operation
14 Coupling Member
15 Facing Surface
16 Rear Side
17 Pressure Plate
18 Stud Bolt
19 Ledge
20 Dowel Pin
21 Spindle
22 Thread Segment
23 Bearing Case
24 Spindle Nut
25 Key Surface
26 Counter Nut
28 Pressure Screw

29 Foot End
30 Threaded Plate
31 Counter Nut
32 Recess
33 Recess
34 Coupling Projection
35 Coupling Projection
36 Bar
P Fitted Key
S Cut Gap

We claim:

1. A coarse material comminution machine comprising:

a rotor having a plurality of blades;

a stator body located on a stator side of the rotor, said stator having at least one adjustable blade;

said blade adjustable by a control device in a direction towards the rotor and in a direction away from the rotor;

the control device having a adjusting slide movable relative to the rotor;

an activating device to move the adjusting slide on a moving surface either in the direction to the rotor or in the direction away from the rotor; and the blade being kinetically coupled to a movement of the adjusting slide and the blade being connected to the adjusting slide by at least one coupling member connectible to the adjusting slide and the blade in form-fitting and detachable fashion;

wherein one coupling member further comprises two coupling projections located at a distance from each other and connected by a bar and the adjusting slide and the blade each have a recess corresponding to the coupling projections for the attachment of a coupling member.

2. The coarse material comminution machine of claim 1, wherein the adjusting slide and the blade each have a facing surface that abut each other for the transmission of a pushing motion of the adjusting slide onto the blade to move the blade towards the rotor.

3. Coarse material comminution machine of claims 1 or 2, wherein the recesses of the blade are end-to-end drill holes.

4. Coarse material comminution machine as claimed in claims 1 or 2, wherein the stator body has at least one fitted key on the moving surface to guide the adjusting slide by engaging complementarily guiding grooves of the adjusting slide.

5. A coarse material comminution machine comprising:

a rotor having a plurality of blades:

a stator body located on a stator side of the rotor, said stator having at least one adjustable blade;

said blade adjustable by a control device in a direction towards the rotor and in a direction away from the rotor:

the control device having a adjusting slide movable relative to the rotor;

an activating device to move the adjusting slide on a moving surface either in the direction to the rotor or in the direction away from the rotor; and the blade being kinetically coupled to a movement of the adjusting slide and the blade being connected to the adjusting slide by at least one coupling member connectible to the adjusting slide and the blade in form-fitting and detachable fashion;

wherein the machine further comprises a pressure plate to fix the blade, said pressure plate having guiding grooves on an underside corresponding to the bars for a form-fitting fixation of the pressure plate in a transversal direction to the motion direction of the adjusting slide and wherein the bar of the coupling members rests on an upper side of the adjusting slide or an upper surface of the blade.

6. Coarse material comminution machine as claimed in claims 1 or 2, wherein the stator body further comprises at least one adjustable pressure screw having a foot end supported by a side of the adjusting slide facing away from the blade.

7. Coarse material comminution machine as claimed in claim 6, wherein the pressure screw is mounted in a thread plate that is held in place in the stator body and that is detachable from the stator body.

8. Coarse material comminution machine as claimed in claims 1 or 2, wherein the stator body has several blades arranged in one row parallel to the outside shell of the rotor and a corresponding number of control devices.

* * * * *